United States Patent [19]

Fincher

[11] Patent Number: 4,926,398

[45] Date of Patent: May 15, 1990

[54] PRESSURE COMPENSATED COMMUNICATION SYSTEM

[75] Inventor: David S. Fincher, South Lake, Australia

[73] Assignee: Divelink Pty Ltd, Western Australia, Australia

[21] Appl. No.: 263,692

[22] Filed: Oct. 28, 1988

[30] Foreign Application Priority Data

Oct. 30, 1987 [AU] Australia ..... PI 5158

[51] Int. Cl.[5] ..... H04R 15/00

[52] U.S. Cl. ..... 367/172; 367/132; 381/169; 128/201.19; 405/186

[58] Field of Search ..... 181/122, 0.5; 367/132, 367/153, 167, 172, 173, 174, 178, 188, 191, 910; 381/169; 128/201.19; 405/186

[56] References Cited

U.S. PATENT DOCUMENTS

| | | | |
|---|---|---|---|
| 518,959 | 5/1894 | Kolbassieff | 367/132 |
| 2,937,244 | 5/1960 | Weinger | 367/173 X |
| 3,174,129 | 3/1965 | Laughlin et al. | 367/910 |
| 3,292,618 | 12/1966 | Davis et al. | 367/132 |
| 3,764,966 | 10/1973 | Abbagnaro | 367/174 |
| 4,013,992 | 3/1977 | Dewberry et al. | 367/910 |
| 4,071,110 | 1/1978 | Payne | 367/132 |

*Primary Examiner*—Brian S. Steinberger

*Attorney, Agent, or Firm*—Reising, Ethington, Barnard, Perry & Milton

[57] ABSTRACT

The present invention provides a pressure compensated communication system having at least one audio transducer, the pressure compensated communication system comprising a fluid tight housing for the or each audio transducer, the or each housing having a corresponding one of the or each of the audio transducers located therein and having an orifice coupled to a pressure compensation means, the pressure compensation means connected to the or each orifice and to a continuous supply of gas at a pressure equal to or slightly greater than the pressure of liquid surrounding the housing.

10 Claims, 2 Drawing Sheets

PRESSURE COMPENSATED COMMUNICATION SYSTEM

The present invention relates to a pressure compensated communication system particularly envisaged for use at sub-atmospheric or super atmospheric pressures.

FIELD OF THE INVENTION

In general, audio transducers, such as microphones and loud speakers, for communication systems are constructed to operate at normal atmospheric pressures. However, such audio transducers have been used at super atmospheric pressures such as in underwater communication systems for divers.

In such cases the audio transducers must be protected from contact with water. Protection is usually achieved by hermetically encasing the audio transducers in epoxy resin. However, the epoxy resin substantially reduces the flow of acoustic energy into and out of the audio transducer, resulting in loss of sound volume and distortion of the transmitted and received sound.

Also, the audio transducer, in use, has an internal pressure set at atmospheric pressure and an outside pressure which increases at a rate of about 100 kpascals for every 10 meters below the surface of the ocean. The resultant pressure imbalance pressurizes the audio transducer and reduces its sensitivity to incident acoustic energy. With continued increase in the pressure imbalance the audio transducer usually experiences mechanical failure.

It is known to use bone type microphones and loudspeakers encased in expoxy resin to shield same from ingress of water but the inside remains at normal atmospheric pressure and so the acoustic volume decreases with depth under water. However, these microphones and loudspeakers have very low sensitivity, poor frequency response, low acoustic volume and therefore not well suited for underwater communication. It is also known to house conventional type audio transducers in hermetically sealed containers with a diaphragm in pressured communication with its surroundings.

In use, super atmospheric pressures, such as experienced under water, deform the diaphragm and pressurize the container so that the audio transducer experiences super atmospheric pressures in balance, that is from within and without.

The general problem of such prior art arrangements is that the amount of compensation achievable is limited by the flexibility of the diaphragm in the container. So a depth will be reached past which no compensation will occur. Also, such diaphragms are prone to failure by perishing or puncturing and otherwise being handled roughly. In such case since the inside of the container is never at a higher pressure than that of the surroundings water enters the container, displaces the air and destroys the audio transducer.

SUMMARY OF THE INVENTION

The present invention provides a pressure compensated communication system having audio transducers with pressure compensation means in communication with a continuous supply of compressed gas (or sub-atmospheric pressure gas) substantially eliminate pressure imbalances between the operating pressure of the audio transducer and the pressure of the surrounding environment.

In accordance with the present invention there is provided a pressure compensated communication system having at least one audio transducer, the pressure compensated communication system comprising a fluid tight housing for the or each audio transducer, the or each housing having a corresponding one of the or each of the audio transducers located therein and having an orifice coupled to a pressure compensation means, the pressure communication means connected to the or each orifice and to a continuous supply of gas at a pressure equal to or slightly greater than the pressure of liquid surrounding the housing.

Preferably, the pressure compensation means interconnects each of the audio transducers.

In the context of the present invention "gas" includes air and gases such as helium often used in deep sea diving and the like.

Also, in the context of the present invention "continuous" in relation to supply of gas means persisting for as long as gas is supplied to the divers using the apparatus of the invention.

The present invention will hereinafter be described with particular reference to operation under the ocean surface and at super atmospheric pressures, although it is to be understood that it could be operated at sub atmospheric pressures.

The present invention will also hereinafter be described with particular reference to audio transducers being microphones and loudspeakers.

BRIEF DESCRIPTION OF THE DRAWINGS

The present invention will now be described by way of example with reference to the accompanying drawings, in which.

DESCRIPTION OF THE INVENTION

Figure 3:
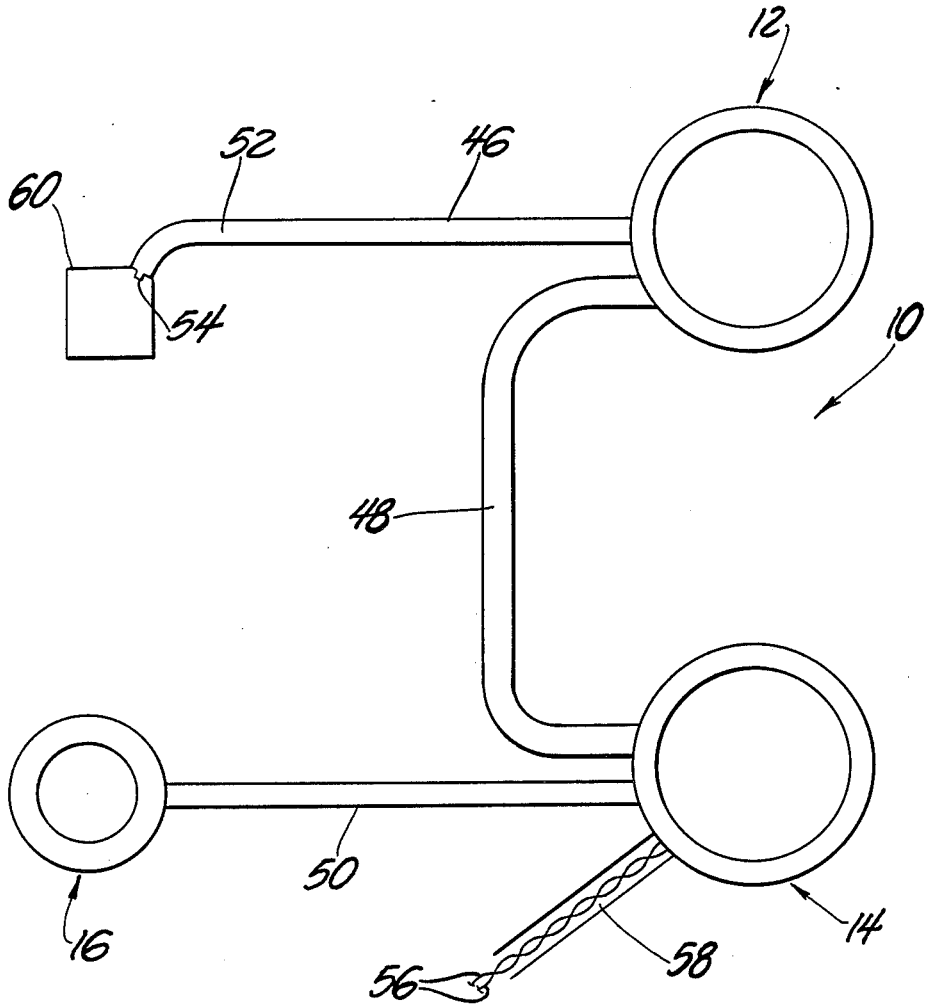
FIG. 3 is a schematic view of the pressure compensated communication system of the present invention.

In FIG. 3 there is shown one exemplary embodiment of a pressure compensated communication system 10 in accordance with the present invention. The system 10 comprises three fluid tight housings 12, 14 and 16 each of a similar construction.

Figure 1:
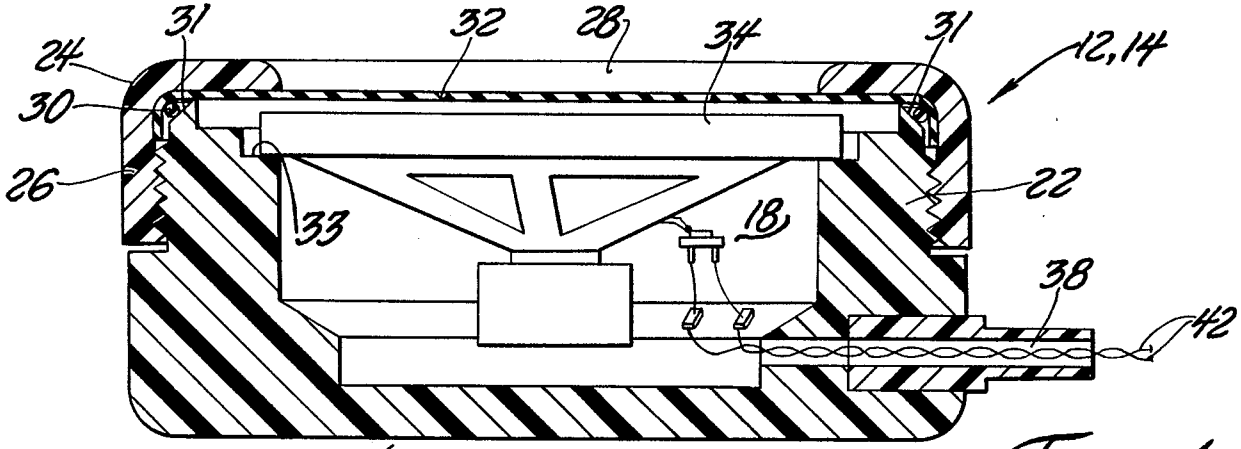
FIG. 1 is a cross sectional view of a housing of a pressure compensated communication system in accordance with the present invention having a loudspeaker in it.
Figure 2:
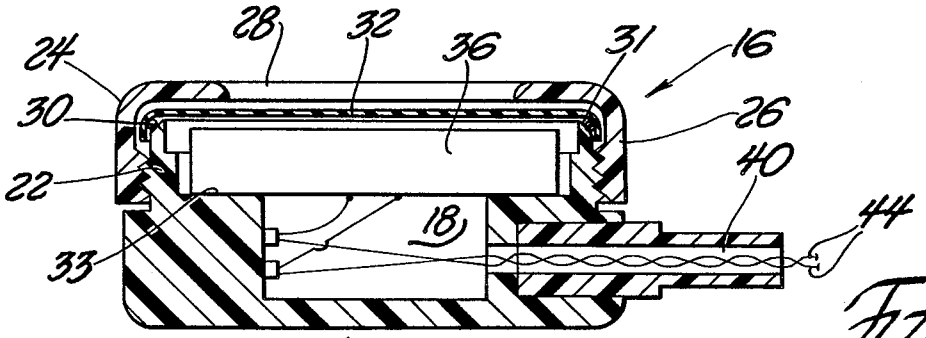
FIG. 2 is a cross sectional view of the housing of FIG. 1 having a microphone in it.

Preferably the housings 12, 14, 16 are relatively rigid in construction and substantially free from resilient deformation. That is any resilient deformation that the housings 12, 14, 16 may experience does not substantially increase the pressure inside the housings 12, 14, 16 so as to provide pressure compensation. It is however, to be understood, that the housings 12, 14, 16 could be relatively flexible such that external pressure could create compensation by deforming the housings 12, 14, 16 to increase the pressure therein. However, such characteristic is of no benefit to the present invention and represents a superfluous feature, not required by the present invention. The housings 12, 14 and 16 each comprise a chamber 18 formed of a base 20 with an externally threaded lip 22 and an apertured cap 24 with an internally threaded skirt 26 as shown in FIGS. 1 and 2. The skirt 26 of the cap 24 is dimensioned to threadedly engage with the lip 22 of the base 20.

The cap 24 has a hole 28 disposed to correspond with the chamber 18.

Typically, the base 20 and the cap 24 are made form plastics material, such as, nylon.

The cap 24 also comprisaes an "O" ring seal 30 seated into it. The seal 30 is disposed to mater with a bevel 31 formed in the lip 22 to create a fluid tight connection between the cap 24 and the base 20 when same are threaded together. Such threading results in a compression of the "O" ring seal 30 between the bevel 31 and the cap 24. Typically, the bevel 31 is at about 45° to the thread of the lip 22. The housings 12, 14 and 16 each also comprise a membrane 32 formed of flexible and fluid tight material such as for example material available under the Trade Mark MYLAR or the like. The membrane 32 is dimensioned to fit between the "O" ring seal 30 and the cap 24 to close off the hole 28 to prevent fluid such as water from entering the chamber 18 via the hole 28.

The membrane 32 preferably is capable of deflection in sympathy with acoustic energy incident upon it so as to transmit the acoustic energy through it.

The cavity 18 is dimensioned to receive an audio transducer such as a loud speaker 34 as shown in FIG. 1 or a microphone insert 36 as shown in FIG. 2. The lip 22 has a seat 33 dimensioned to loosely receive a cone frame of the audio transducer 34, 36. The loose fit is such as to allow passage of some air or gas from the chamber 18 to the membrane 32 to equalize the pressure across the audio transducer 34, 36.

The audio transducer 34 or 36 is preferably loosely clamped in place in the housing 12, 14 or 16 by the threaded engagement of the cap 24 to the base 20. The audio transducer 34 or 36 is thereby disposed adjacent the membrane 32.

The housings 12, 14 and 16 each also comprise an orifice 38 and 40 respectively. The orifice 38 carries electrical wires 42 which are connected to the loud speaker 34 and the orifice 40 carries electrical wires 44 which are connected to the microphone insert 36.

The orifices 38 and 40 are in fluidic communication with the respective chambers 18 and therefore the respective audio transducers 34 and 36.

It is to be noted that if the MYLAR membrane 32 is subjected to a large pressure gradient it will be deflected into the chamber 18, crushing the audio transducer and tearing, thus allowing water into the chamber 18. Accordingly, it is essential to equalize the pressure in the chamber 18 and adjacent the inside of the membrane 32 with that of the liquid or gas in the surroundings.

The pressure compensated communication system 10 also comprises a pressure compensation means conveniently in the form of a plurality of hoses 46, 48 and 50 connected between the orifices 38 and 40, as shown in FIG. 3, so as to maintain the chambers 18 of each of the housings 12, 14 and 16 in fluidic communication so that the pressure within each of the housings 12, 14 and 16 is maintained substantially the same. The hose 50 connects the housings 14 and 16 together and the hose 48 connects the housings 12 and 14 together.

The system 10 of FIG. 3 schematically shows two orifices in each of the the housings 12 and 14 but it is to be understood that one orifice could be sed with a T piece to join the hoses 46 to 48 and 48 to 50 and to the orifices 38 of the housings 12 and 14.

The hose 46 has a free end 52 terminating in a relatively small aperture 54. That is the aperture 54 is small relative to the diameter of the hose 46. The free end 52 is arranged to be coupled to a continuous supply of fluid 60, such as a supply of air, which fluid is at a pressure substantially equal or slightly greater than (i.e. 3 kpa greater than) the pressure of the environment surrounding of the housings 12, 14 and 16.

In one embodiment, for communication for underwater divers the hose 46 has its free end 52 connected to or mounted into a face mask used by the diver, which face mask is connected to a continuous supply or pressurized air, and sometimes other gases.

The face mask is intended to be of the full face type in which the diver does not have a mouth piece supplying air into his/her mouth but a regulator supplying air into the mask. Such full face type masks generally operate at about 3 kPa above the pressure of the surrounding water to reduce the likelihood of ingress of water into the mask. Air is generally supplied by an air hose from the surface of the ocean or from an aqualung air tank to the face mask. The aperture 54 is preferably relatively small to reduce the likelihood of ingress of water or moisture into the housings 12, 14 or 16.

The wires 42 and 44 are laid inside the tubes 48 and 50 to the housing 14 whereat they connect together and pass out of the housing 14 via wires 56. The wires 56 run in a watertight cable 58 to an amplifier or the like at a location either remote from the diver, such as at the ocean surface, or to a wireless transceiver carried by or upon the diver.

It is envisaged that the housings 12 and 14 could have a diameter of about 70 mm and a thickness of about 35 mm and the housing 16 could have a diameter of about 42 mm and a thickness of about 20 mm.

It is envisaged that the loudspeakers 34 and the microphone 36 all be wired in parallel connection by the wires 42 and 44, for use in a simple communication system. Alternatively the microphone 36 could be wired separately to the loudspeakers 34, resulting in four airs 56 for use in a duplex communication system.

It is also envisaged that the orifices 38 and 40 could be formed by spigots threaded or welded into holes in the housings 12, 14, 16.

It is also envisaged that the microphone insert 36 could be a miniature loudspeaker.

In use, the housings 12 and 14 are located, in the present embodiment, in the divers full face mask adjacent his/her ears. Depending on the type of mask the housings 12 and 14 may be immersed in water. At such location the housings 12 and 14 seal the loudspeakers 34 from the water and the membrane 32 allows passage of acoustic energy from the loudspeaker 34 out of the housing 12 and 14 to the divers ears.

The housing 16 is located in the divers full face mask adjacent the persons mouth so as to receive acoustic energy when the person speaks. The housing 16 may be formed into the mask with part of the housing immersed in water. The acoustic energy incident on the housing is allowed to pass into the chamber 18 through the membrane 32. The acoustic energy is converted to electrical energy by the microphone insert 36 and output to the wires 44 and sent along the wires 56 for amplification and the like at the ocean surface, such as on a boat used to supply air to the diver or at the wireless transceiver carried by or upon the diver. Hence, the diver can communicate with persons on the boat or to other divers.

Electrical signals from the amplifier are transmitted to the loudspeakers 34 via the wires 56 for production of acoustic energy and communication of voice messages to the diver. The hose 46 has its free end 52 fixed to the full face mask so that air in the mask passes to the chambers 18 in the event that the chambers are at a lower pressure than the pressure of the mask and air passes from the chambers 18 to the mask in the reverse case. Accordingly, the loudspeakers 34 and the microphone insert 36 are not operated at a substantial pressure gradient and so operate normally. That is the pressure gradient will usually be no more than about 3 kPa, with the air pressure being the greater. As the diver descends the air pressure in the mask is increased to compensate the diver for the increase in water pressure. Consequently the air pressure in the chambers 18 is also increased by pressure of air through the hole 54. The reverse occurs when the diver ascends. Thus, the apparatus 10 does not consume air.

In the event that the apparatus 10 develops a leak and is no longer fluid tight with respect to the surrounding environment, a small amount of compressed air will escape since the air pressure is about 3 kPa above the water pressure. Consequently ingress of water in such circumstances is resisted.

The present invention has the benefit of relatively undistorted audio communication and attainment of reasonable sound pressure levels independent of the pressure of the surrounding environment in which the audio transducers 34 and 36 operate.

Also, since the loudspeakers 34 are housed in the housings 12 and 14 the base frequency response and hence clarity is improved. In the absence of the housings 12, 14, 16 apart from problems of pressure gradients, sound pressure waves from behind the loudspeakers 34 interact with those created in front of the loudspeaker and serve to reduce base response, clarity and fidelity as a whole.

Further, the audio transducers 34 and 36 remain relatively dry.

Still further, due to the housings 12, 14 and 16 the acoustic volume is much greater than would otherwise be the case.

Still further, due to the pressure compensation the fidelity of the audio transducers 34, 36 is maintaned independent of operating depth in water.

Still further, by virtue of the positive, but small pressure gradient developed the apparatus 10 is substantially immune to ingress of water even if a fluid leak develops. It is to be noted that the apparatus 10 fill up with water from within the mask only if there was a failure in the air supply to the mask and under such conditions the diver would drown.

It is also to be noted that prior art systems have striven for totally closed systems of operation whilst the apparatus 10 of the present invention is an open system as far as air communication is concerned and relies on the divers mask to create a closed system as far as water is concerned. It is to be noted that by virtue of its construction the apparatus 10 is serviceable.

It is envisaged that polycarbonate cone loudspeakers 34 be used in the invention so as to be less prone to damage by water vapour which may collect in the chamber 18.

It is also envisaged that the pressure in the housings 12, 14, 16 could be between 1 to 10 kPa greater than their surroundings.

Modifications and variations such as would be apparent to a skilled addressee are deemed within the scope of the present invention.

I claim:

1. A pressure compensated system to be submerged in a surrounding liquid and having at least one audio transducer, the pressure compensated system comprising a fluid tight housing for containing the audio transducer, the housing having an orifice pressure compensation means connected to the orifice for receiving a continuous supply of gas at a pressure equal to or slightly greater than the pressure of liquid surrounding the housing, the housing comprising a base of relatively inflexible material having formed in the base a chamber to receive the audio transducer, an apertured cap fixable to the base, a fluid tight membrane disposed between the base and the apertured cap to overly the chamber and in communication with the surrounding liquid at a first surface and in communication with the supply of gas at a second surface, and sealing means disposed to seal the membrane to the base for preventing the surrounding liquid from coming into the chamber.

2. A pressure compensated system according to claim 1, in which the pressure compensation means comprises a first hose connected between the housing and a second housing containing a second audio transducer to maintain the first housing and the second housing in fluid communication therewith and a second hose adapted to be connected to the continuous supply of gas.

3. A pressure compensated system according to claim 2, in which the second hose is adapted to be fixed in fluid communication with an underwater divers face mask.

4. A pressure compensated system according to claim 3, comprising electrical cables interconnected to the audio transducer, the electrical cables being disposed within the hoses between two of the audio transducers.

5. A pressure compensated system according to any one of the claims 1 and 3 to 5 in which the base comprises a lip for attachment of the cap, the lip having an outside bevel, and the sealing means comprising an "O" ring seal, the "O" ring seal being disposed between the bevel and the cap, the bevel and the cap cooperating to compress te "O" ring seal into sealing engagement between them.

6. A pressure compensated system according to claim 3 in which the pressure compensation means maintains the pressure of gas within each housing at between 1 to 10 kPa above the pressure of the surrounding liquid.

7. A pressure compensated communication system to be submerged in a surrounding liquid and having at least two audio transducers, the pressure compensated communication system comprising a first fluid tight housing for containing a first audio transducer, a second fluid tight housing for containing a second audio transducer, the first and second housings having an orifice, pressure compensation means for receiving a continuous supply of gas at a pressure equal to or slightly greater than the pressure of surrounding liquid, the pressure compensation means comprising a hose connected between the orifice of the first housing and the orifice of the second housing to maintain the first housing and the second housing in fluid communication and a second hose adapted to be connected to the continuous supply of gas.

8. A pressure compensated communication system according to claim 7, in which the housing comprising a base of relatively inflexible material having formed in it a chamber to receive the audio transducer, an apertured cap fixable to the base, and a fluid tight membrane disposed between the base and the cap to overly the chamber and in communication with the surrounding liquid at a first surface and in communication with the supply of gas at a second surface, and sealing means disposed to seal the membrane to the base for preventing the surrounding liquid into the chamber.

9. A pressure compensated system to be submerged in a surrounding medium having at least one audio transducer, the pressure compensated system comprising a medium tight housing for containing the audio transducer, the housing having an orifice, pressure compensation means connected to the orifice for receiving a continuous supply of pressurized medium at a pressurized equal to or slightly greater than the pressure of the surrounding medium the housing, the housing comprising a base of relatively inflexible material having formed in it a chamber to receive the audio transducer, an apertured cap fixable to the base, and a medium tight membrane disposed between the base and the cap to overly the chamber and in communication with the surrounding medium at a first surface and in communication with the supply of pressurized medium at a second surface, and sealing means disposed to seal the membrane to the base for preventing the surrounding medium from coming into the chamber.

10. A pressure compensated system according to claim 9, in which the pressure compensation means comprises a first hose connected between the housing and a second housing containing a second audio transducer to maintain same in fluid communication therewith and a second hose adapted to be connected to the continuous supply of pressurized medium.

* * * * *